United States Patent [19]

Endo et al.

[11] 4,340,631

[45] Jul. 20, 1982

[54] THICK-AND-THIN FIBERS AND PRODUCTS THEREFROM

[75] Inventors: Tadakazu Endo; Shigemitsu Saitoh, both of Ohtsu, Japan

[73] Assignee: Toray Industries, Inc., Tokyo, Japan

[21] Appl. No.: 100,974

[22] Filed: Dec. 6, 1979

[51] Int. Cl.[3] ..... D02G 3/00; D03D 27/00

[52] U.S. Cl. ..... 428/89; 428/92; 428/359; 428/398; 428/399

[58] Field of Search ..... 428/89, 91, 92, 359, 428/362, 397, 398, 399, 400

[56] References Cited

U.S. PATENT DOCUMENTS

| | | | |
|---|---|---|---|
| 2,370,112 | 2/1945 | Truitt | 428/399 X |
| 3,069,747 | 12/1962 | Adams | 264/290.5 X |
| 3,116,197 | 12/1963 | Kasey, Jr. | 428/395 X |
| 3,691,748 | 9/1972 | Buzano | 428/399 X |
| 3,930,106 | 12/1975 | Mihara et al. | 428/399 |
| 4,059,950 | 11/1977 | Negishi et al. | 428/371 X |
| 4,201,813 | 5/1980 | Brumlik | 428/400 X |

*Primary Examiner*—Lorraine T. Kendell
*Attorney, Agent, or Firm*—Austin R. Miller

[57] ABSTRACT

Disclosed is a thick-and-thin fiber or fibers, wherein the fineness thereof changes gradually and periodically along the longitudinal direction thereof, and is characterized by (a) the thick-and-thin recurring length of five to 500 millimeters, (b) the thick-and-thin ratio of four to 50, (c) the average fineness of 0.05 to 2000 deniers, and (d) almost constant cross section areas at both the thick and the thin portions, respectively. Also disclosed is a thick-and-thin staple fiber or fibers formed therefrom by cutting the thick-and-thin fibers at a predetermined interval. Additionally, disclosed is a fabric made of the thick-and-thin fibers or staple fibers as a component thereof. Disclosed is a method to produce the thick-and-thin fibers comprising (1) a step wherein molten fiber forming polymer is extruded through spinneret holes at a constant throughput, (2) a step wherein the extruded filaments run through a short gaseous gap whose length is in the range of 0.1 to 6 millimeters before they plunge into liquid for the abrupt solidification by cooling, (3) a step wherein the solidified undrawn filaments are touched by at least one vibrating substance before being withdrawn at a constant speed, (4) a step wherein the undrawn filaments are drawn by some roller systems, and (5) a step wherein the drawn filaments are thermally set.

9 Claims, 13 Drawing Figures

THICK-AND-THIN FIBERS AND PRODUCTS THEREFROM

BACKGROUND OF THE INVENTION

The present invention relates to thick-and-thin fibers wherein the thick-and-thin ratio is sufficiently high, the thick-and-thin recurring length is short and uniform, and the phases of the thick-and-thin profile among multi-filaments are practically identical.

Thick-and-thin fibers whose fineness varies along the longitudinal direction have been known. They are used, for example, in pile fabrics so as to simulate natural furs because the profile and the fiber properties of the thick-and-thin fibers are similar to the hair of the natural furs.

Thick-and-thin fibers conventionally made of synthetic polymers, however, have so small a thick-and-thin ratio, that is, of less than four, that they are insufficient to be used to simulate hair, for example, of natural mink fur. Since it was difficult to produce the thick-and-thin multi-filaments or tow with a uniform length between the adjacent thick portions and a good phase coherency of the thick-and-thin profile among filaments, only dissimilar thick-and-thin staple fibers resulted when the thick-and-thin filaments or tow were cut to a constant fiber length. This was one of the serious drawbacks against producing good simulated furs with excellent appearance and hand.

The Japanese Patent Pubrication No. 52-47053, for example, describes a process for the preparation of thick-and-thin fibers wherein undrawn filaments are heated intermittently, and drawn at a constant speed to a predetermined length to stretch selectively the heated region with a result that a tapered thin portion is formed at the heated region. The filaments are further drawn and cut into the thick-and-thin staple fibers which are characterized by the following formulae:

$$1/D > 30, \text{ and } d = d' < 0.5D,$$

wherein

D is the fiber diameter at the thick portion, d is the fiber diameter at the thin portion between the adjacent thick portions, d' is the fiber diameter at a sharpened end, and 1 is the length from the middle thin portion up to the sharpened end.

This process may be useful to render a monofilament into a thick-and-thin fiber with a relatively uniform thick-and-thin recurring length, but it seems to have difficulty in manipulating multi-filaments or two because it is quite difficult to heat each filament at the same corresponding position. Therefore, good phase coherency of the thick-and-thin profile cannot be attained. In addition, since it becomes more difficult to draw the heated portion selectively as the fiber fineness increases, thick-and-thin fibers whose thick-and-thin ratio is more than four becomes technically difficult.

A method of producing a filament having uniformly recurring symmetrically tapered portions has been disclosed in U.S. Pat. No. 2,418,492, which comprises extruding an organic filament forming material in a molten condition at a constant volume rate through a spinneret across an air gap into a liquid cooling bath maintained at a temperature below the temperature of solidification of said material, and directly withdrawing the filament formed in accordance with a repetitive schedule of linear rates comprising a period of acceleration, a period of deceleration of greater duration than that of acceleration, and a period of uniform withdrawal. This method may enable us to produce thick-and-thin fibers with a good phase coherency of the thick-and-thin profile among filaments, but it is impossible to combine the extrusion process with the drawing process which is necessary for good end use because the non-uniform withdrawal, which is intentively applied, persists all over the running filaments in the process.

It is well known that there are many methods to vary the fiber fineness along its longitudinal direction, including a periodical change in the throughput, take-up velocity or spinning length during the spinning process; or a periodical change in drawing ratio or length of the drawing zone during the drawing process; or an intermittent drawing to impart undrawn portions. Although these methods seem to be possible in principle, they betray their incapability when it comes to making the thick-and-thin fibers with the high thick-and-thin ratio herein intended, and they cannot be used from the entrepreneur's point of view because of the difficulties with machinery.

The periodical change in the throughout can be, for example, attained by the use of the so-called pulsating pump or the method described in the Japanese Patent Publication No. 43-20246, wherein the constant metering has been coupled with a periodical change in the resident volume before the extrusion. This method cannot be used to produce the thick-and-thin fibers with high thick-and-thin ratio and short recurring length as intended in the present invention because too intricate a machinery is required and also because the viscoelastic property of the polymer concerned damps the effect of the change in the resident volume.

Another method of varying the take-up velocity requires intricate machinery for the periodical change in the peripheral velocity of the rotating rollers. Some devices for this end can be found, for example, in U.S. Pat. No. 2,418,492 and British Patent No. 1,1086,511. However, the change in the take-up velocity, as already pointed out, makes it difficult to combine the extrusion process with the drawing process which is necessary for good end use. The separation of the processes, therefore, becomes unavoidable, which results in a deleterious effect on the phase coherency of the thick-and-thin profile among multi-filaments. To obtain the thick-and-thin fibers herein intended, the take-up velocity should be periodically altered from about zero to several tens or hundreds of meters per minute, so that the rotating rollers have to swiftly change their rotating speed against their inertial force. This requirement may be temporarily realized in an experimental scale, but its permanent realization is so difficult that the industrial application of this method becomes impossible.

Another method of varying the spinning length in a melt spinning process consists of some manipulations by which the spinning length between the spinneret and the take-up device is altered. However, the spinning length in melt spinning is usually so great that the thick-and-thin fibers with high thick-and-thin ratio and short thick-and-thin recurring length as intended in the present invention cannot be attained.

Another method adopted in the drawing process is an imperfect drawing, wherein uniform undrawn filaments are drawn intentionally under a low drawing ratio so that some undrawn portions may be included. However, since there is a certain natural drawing ratio in which the imperfect drawing is realized, the thick-and-thin ratio is determined a priori and must remain at a low level. This is a fatal drawback for the present purpose. On top of that, this method, wherein undrawn portions of filaments are intentionally included by the application of a certain low drawing ratio less than the natural drawing ratio, is very poor at giving thick-and-thin fibers with a uniform thick-and-thin recurring length which is one of the important objects of the present invention. The vulnerability at the undrawn portions to a relatively small force or a chemical attack may also cause another problem in later processing.

As is apparent in the above explanation, the conventional miscellaneous methods cannot afford the thick-and-thin fibers intended in the present invention, wherein the thick-and-thin ratio is sufficiently high, the thick-and-thin recurring length is short and uniform, and the phase coherency of the thick-and-thin profile among filaments is also good.

BRIEF SUMMARY OF THE INVENTION

It is a primary object of the present invention to provide thick-and-thin multi-filaments which have a great advantage in developing some new goods by the use of the thick-and-thin characteristic, wherein the thick-and-thin ratio is sufficiently high, the thick-and-thin recurring length is short and uniform, and the phases of the thick-and-thin profile is practically identical among the multi-filaments.

Another object of the present invention is to provide thick-and-thin staple fibers, wherein almost all of the staple fibers have practically identical thick-and-thin profiles together with almost equal fiber length and average fiber fineness.

Still another object of the present invention is to provide various kinds of goods which utilize the characteristic shape of the thick-and-thin fibers, especially pile fabrics to simulate natural furs wherein the thick-and-thin fibers constitute pile that stands close together with thick portions floating over the base fabric by means of the thin portions which are anchored on the base fabric.

Further object of the present invention is to provide a process to produce the above-mentioned thick-and-thin fibers in an industrial scale with much benefit.

Still further objects of the present invention shall become apparent from the following explanation.

DETAILED DESCRIPTION OF THE INVENTION

The thick-and-thin fibers of the present invention can be characterized by the following items:

(a) The thick-and-thin recurring length defined as a longitudinal length along the fiber axis between adjacent thick portions lies in the range of five to 500 millimeters.

(b) The thick-and-thin ratio defined as a ratio of the cross-sectioned area of the thick portion to that of the thin portion lies in the range of four to 50.

(c) The cross-sectional areas at the thick portions and those at the thin portions are almost constant, respectively.

Figure 1:
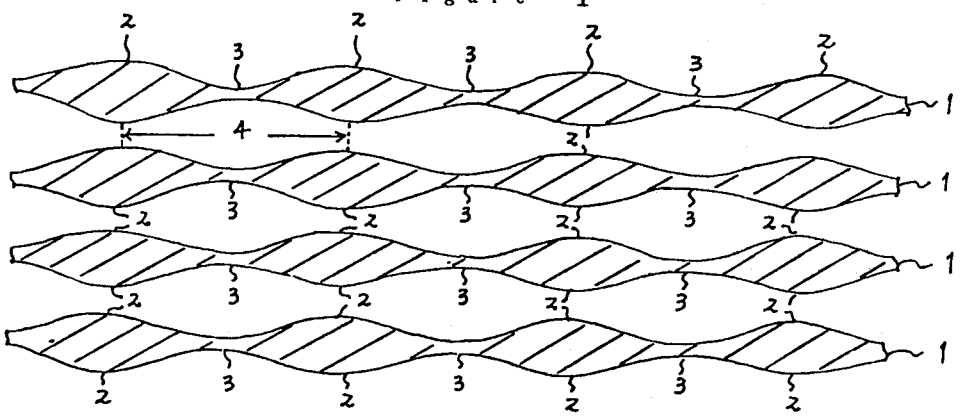
FIG. 1 schematically shows a side view of the thick-and-thin fibers according to the present invention.
Figure 2:
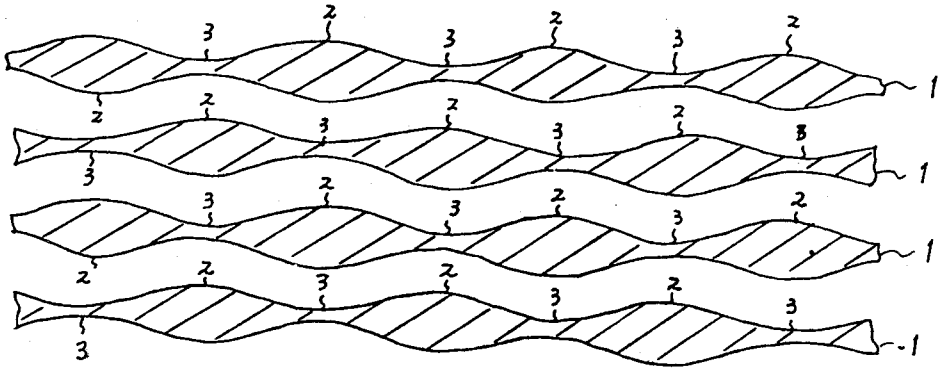
FIG. 2 shows another example of the thick-and-thin fibers according to the present invention.

Referring to FIG. 1, the thick-and-thin filament 1 has thick portion 2 and thin portion 3 with a thick-and-thin recurring length 4 and the thick-and-thin ratio being higher than four. It is characterized in that the cross-sectional area at the thick portion 2 and at the thin portion 3 are almost constant, respectively, and in that when multi-filaments are taken into account, all the phases of the thick-and-thin profile among the filaments are practically identical. FIG. 2 illustrates another example of the thick-and-thin fibers according to the present invention, in which the phases of the thick-and-thin profile among the multi-filaments do not necessarily coincide with each other.

When the area of the cross section of a thick-and-thin fiber is recorded along the fiber axis, a periodical change in the area can be seen. The ratio of the largest value of the area to the smallest value of it in an arbitrarily selected longitudinal domain that includes at least one thick and thin portions of which each is here called the thick-and-thin ratio in the present invention. This thick-and-thin ratio can be considered as fiber fineness ratio at the corresponding thick and thin portions. When a circular cross section is considered, this thick-and-thin ratio should be principally equal to the square of the diameter ratio at the corresponding thick and thin portions. The thick-and-thin recurring length is the distance between adjacent thick portions measured in the longitudinal direction of the fiber.

In the following explanation, the coefficient of variation of the thick-and-thin recurring length is calculated from data measured on 50 samples arbitrarily selected according to the following formula:

$$CV(\%) = \frac{\sqrt{\frac{1}{50}\sum_{i=1}^{50} l_i^2 - L^2}}{L} \times 100,$$

wherein $l_i$ is the i-th value of the thick-and-thin recurring length in the 50 samples arbitrarily chosen, and L is an average value of the thick-and-thin recurring length of the above 50 samples.

The inphase value which shall indicate the phase coherency of the thick-and-thin profile among the multi-filaments is here defined by the following formulae:

$$G = \left( 1 - \frac{\sum_{i=1}^{n} \left| m_i - \frac{\sum_{j=1}^{n} m_j}{n} \right|}{n(L/2)} \right) \times 100,$$

wherein

G is a notation for the inphase value, n is number of the filaments in the thick-and-thin filaments, $m_i$ and $m_j$ are the nearest distance of the thick portion from the standard position set out arbitrarily on the filaments with sign to designate the direction, and L is an average thick-and-thin recurring length as defined above.

If all the phases of the thick-and-thin profile among the multi-filaments coincide with each other, the inphase value G takes a value of 100. This value, of course, decreases as the phase coherency decreases.

The thick-and-thin fibers of the present invention have a special feature characterized by the thick-and-thin ratio of four to 50, the thick-and-thin recurring length of five to 500 millimeters, and the thick-and-thin inphase value of at least 60 percent. The higher the thick-and-thin ratio, the better the goods which reflect the excellent features of the thick-and-thin fibers result. If the thick-and-thin ratio is less than four, fabrics made of the mixed yarn, in which the thick-and-thin fibers are included, cannot exhibit any special characteristic attributable to the thick-and-thin fibers. On the other hand, if the thick-and-thin ratio is more than fifty, the difference of the fiber texture at the thick portion and thin portion becomes so large that the thick-and-thin fibers thus obtained are no longer useful for the fabrication. This thick-and-thin ratio can be arbitrarily chosen in the range of four to fifty according to the kind of fabrics or final goods and usage intended. It should be preferably selected in the range of four to 20 when used as multi-filaments, four to 40 when used as staple fibers, and four to 20 when used in pile fabrics for simulated furs.

The thick-and-thin recurring length should lie in the range of five to 500 millimeters, preferably five to 200 millimeters. The thick-and-thin recurring length less than five millimeters is very difficult to be realized in an industrial sense. On the other hand, a thick-and-thin recurring length greater than 500 millimeters cannot show any characteristics attributable to the thick-and-thin fibers in the final goods, especially in pile fabrics.

Figures 3A, 3B, 3C, 3D, 3E, 3F, 3G, 3H:
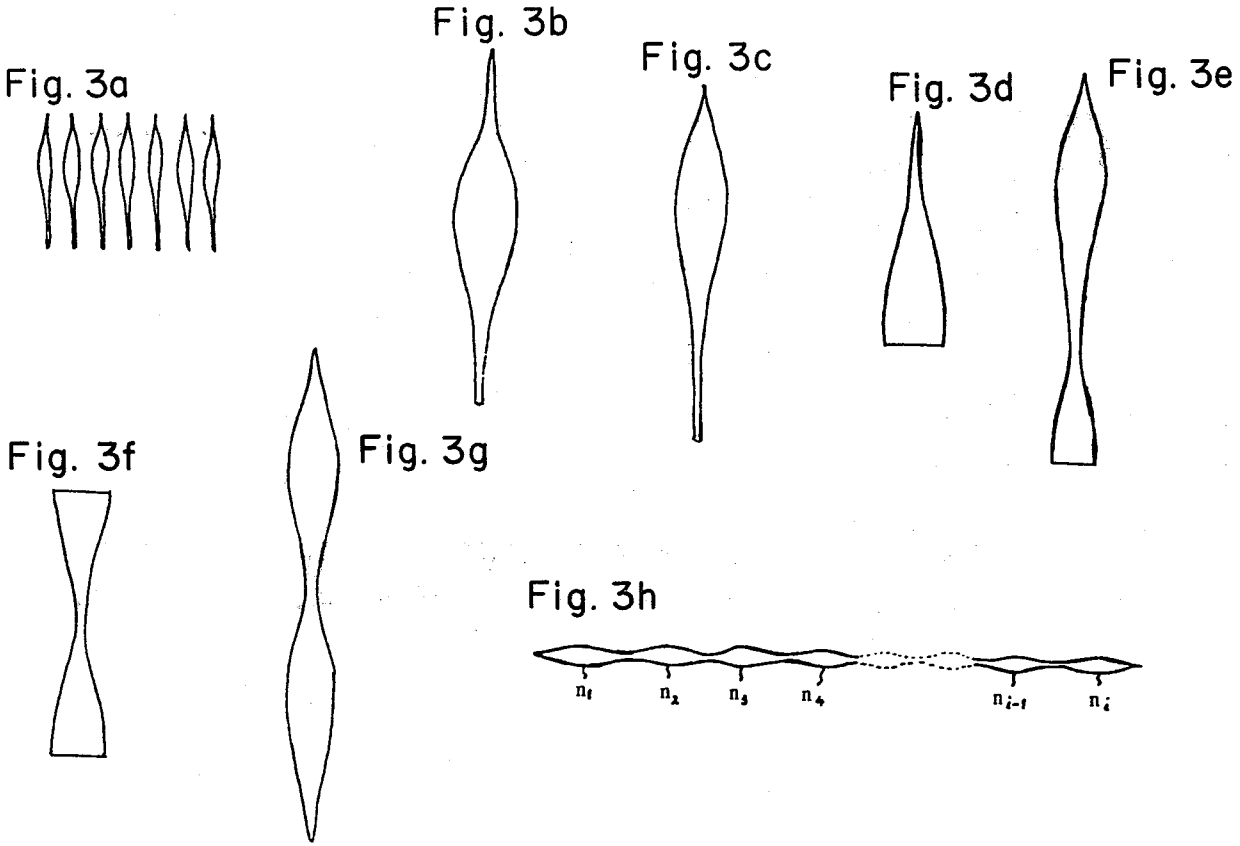
FIG. 3(*a*) shows an example of the thick-and-thin staple fibers according to the present invention, and FIGS. 3(*b*) to 3(*h*) show various examples of thick-and-thin staple fibers that can be obtained from the thick-and-thin fibers according to the present invention.

The thick-and-thin filaments with a good phase coherency of the thick-and-thin profile, as shown in FIG. 1, can be converted into staple fibers with practically the same thick-and-thin profile and dimension as depicted in FIG. 3 because it is easy to position the cutting place all at once in the filaments. FIG. 3(*a*) illustrates the thick-and-thin staple fibers obtained by cutting the thick-and-thin filaments of good phase coherency at the thin portions on both sides of each thick portion. The thick-and-thin staple fibers thus obtained are practically of the same profile and dimension. FIGS. 3(*b*) to 3(*g*) show the other examples of the thick-and-thin staple fibers which can be obtained by cutting the thick-and-thin filaments of good phase coherency at a predetermined interval.

In one embodiment of the present invention, the inphase value of the thick-and-thin fibers should be at least 60 percent, preferably in the range of 70 to 98 percents. The thick-and-thin staple fibers according to the present invention can be preferably produced by cutting the thick-and-thin multi-filaments at a predetermined interval as explained above. If the thick-and-thin multi-filaments whose inphase value is more than 60 percent are used to be cut into the staple fibers with a proper fiber length, good thick-and-thin staple fibers, at least 50 percent of which consist of practically the same thick-and-thin profile, result. These thick-and-thin staple fibers can produce an excellent pile fabric which is characterized by good hand and touch and brilliancy.

If the phase coherency of the thick-and-thin profile among filaments is very poor and the inphase value is small, the thick-and-thin staple fibers obtained by cutting can only consist of various dissimilar thick-and-thin profiles. These can be used in another usage wherein such a various mixture of profiles is preferred. The thick-and-thin filaments with low inphase value may be especially suitable to make spun yarns by simultaneous cutting and spinning as is common in the art.

The thick-and-thin fibers of the present invention, whether they are continuous multi-filaments or staple fibers, can be used by themselves or as a mixed yarn with some conventional synthetic fibers, wool, cotton, and hemp. However, in the latter case wherein the mixed yarn is considered, the content of the thick-and-thin fibers should lie in the range of one to 80 weight percent, and preferably two to 70 weight percent, so that the characteristic feature of the thick-and-thin fibers, i.e., an excellent decorative effect and good hand, may be fully utilized.

When the thick-and-thin fibers are used as staple fibers, their proper fiber length and the average fineness are 2.5 to 250 millimeters and 0.05 to 2000 denier respectively, depending on the kind of the final goods or usage intended. The preferable range of the fiber length and the average fineness are 20 to 150 millimeters and 0.05 to 500 denier, respectively. Especially, in case of pile fabrics the thick-and-thin staple fibers with the fiber length of 2.5 to 250 millimeters and the average fineness of 0.5 to 500 denier are desirable for the excellent hand and touch and good processibility. For brushes heavier fineness of 10 to 2000 denier is preferable. Although the thick-and-thin staple fibers have a spinnerability without crimp, crimp can be added if desired. The number of the recurring thick portions in a thick-and-thin staple fiber may be in the range of one to 100 as depicted in FIG. 3(*h*) wherein the suffix i is any integer from one to 100. There cannot be found any additional advantages over the upper limit of 100 in the application of the thick-and-thin staple fibers.

When the thick-and-thin fibers are used as multifilaments by themselves, there is no limit in the fiber fineness, wherein the regularity of the thick-and-thin profile, the high thick-and-thin ratio, and the short and uniform thick-and-thin recurring length give the final goods a characteristic appearance, brilliancy, and an excellent hand. In case of mixed filament yarn or mixed-twisted filament yarn with some conventional filaments, the content of the thick-and-thin fibers should be, as in the case of the staple fibers, in the range of one to 80 weight percent, and preferably two to 70 weight percent.

The polymer which constitutes the thick-and-thin fibers of the present invention can be any already known fiber forming synthetic polymer such as polyesters, polyamides, polyacrylonitriles, and their copolymers. Especially polyesters and poly(butyleneterephthalate), if specified, are the best selection among them.

The thick-and-thin fibers can be made not only of a single polymer above-mentioned, but also of at least two polymers in any form of a mixed style or a conjugated style common in the art. They can also be hollow fibers. In addition, the thick-and-thin fibers can have properties of high shrinkage or latent crimpability which can be induced by a combination of polymers and a proper selection of the drawing and heating conditions, which is well known in the art.

The conventional fibers which are used with the thick-and-thin fibers of the present invention can be any of the already known synthetic fibers made of polyesters, polyamides, polyacrylonitriles, and their copolymers, as well as the natural fibers such as wool, cotton, and hemp. They may be selected according to the performance expected in the final goods or by the usage, and should not be confined by the above list. The fiber length and its fineness of the conventional staple fibers should be in the range of one to 250 millimeters and 0.05 to 2000 denier, respectively. In case of multifilaments the fineness should be in the range of 0.05 to 2000 denier.

The thick-and-thin fibers of the present invention can be converted into various kinds of knitted, woven or nonwoven fabrics which reflect the characteristics of the thick-and-thin fibers by means of well known techniques such as weaving, knitting and the other miscellaneous procedures common in the art. Mixing with conventional regular fibers is preferable, wherein the thick-and-thin fibers should be exposed on or over the surface of the knitted, woven or nonwoven fabrics. Methods or machines to make such fabrics wherein the thick-and-thin fibers are exposed on or over the surface of the base fabric can be exemplified by double velvet loom, sealskin fabric knitting machine, tufting machine, sliver knitting machine, needle punching machine, all common in the art. Among the fabrics made of the thick-and-thin fibers together with regular fibers, pile fabrics wherein the thick-and-thin fibers of the present invention are used as the pile at least in a part with their thick portions floating over the ground fabric by means of thin portions anchored on the surface of it well resemble natural furs in their appearance hand and structure.

Figure 4:
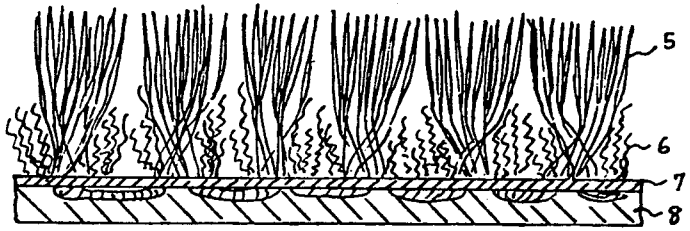
FIG. 4 illustrates a pile fabric in which the thick-and-thin fibers are used as a component of the pile.

A schematic example of pile fabrics to simulate natural furs is given in FIG. 4, wherein 5 is the thick-and-thin fiber, 6 is conventional fiber of constant fineness, 7 is a base fabric, and 8 is backing layer. When the thick-and-thin fibers are used as one of pile components and their length is greater than the height of the other conventional fibers as depicted in FIG. 4, the uppermost surface of the pile fabric is covered with the thick-and-thin fibers, producing a simulated fur with an excellent hand and appearance just like natural mink fur.

Thick-and-thin fibers with a high thick-and-thin ratio, a short and uniform thick-and-thin recurring length, and a good phase coherency of the thick-and-thin profile among multi-filaments can be industrially obtained by the method described below in detail. The thick-and-thin fibers of the present invention can now be produced by the following steps combined sequentially:

(1) A step wherein molten fiber forming polymer is extruded through a spinneret hole at a constant throughput, (2) A step wherein the extruded filament runs through a short gaseous gap whose length is less than six millimeters before it plunges into liquid for solidification by cooling or coagulating, (3) A step wherein the solidified undrawn filament is touched by at least one vibrating substance of any form before being drawn at a constant speed by rotating roller system, (4) A step wherein the undrawn filament is drawn by some rotating roller systems, and (5) A step wherein the drawn filament is heat set if desired.

In the above items and the following explanation single nouns for polymer, filament, and hole may be changed into plural ones and interpreted as such if desired.

Figure 5:
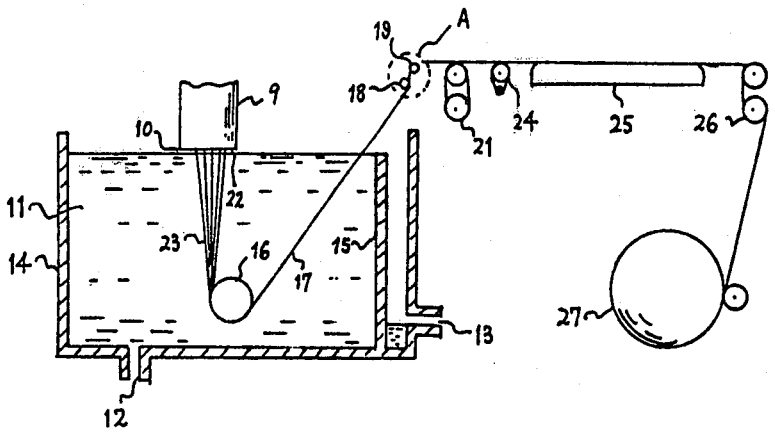
FIG. 5 is a side sectional view of illustrative embodiment of the method for the present invention.

The method of the present invention will be now explained in detail with reference to FIG. 5. The filament 22 which is extruded in molten state through a hole in the spinneret 9 runs through a short gaseous gap 10 and thereafter plunges into liquid quenching bath 11 so that it may be abruptly cooled or coagulated and solidified. The liquid quenching bath 11 is provided with inlet 12 for the quenching liquid, and outlet 13 for the drain of the overflowed liquid from a dam 15 which has been installed to maintain the liquid level in the vessel 14. The running filament 15, submerged in the liquid bath 11, changes its running direction by means of guide 16, and again emerges into the air, and runs on guide 18 and vibrating guide 19, and then is withdrawn at a constant speed by the rotating roller system 21. The guide 18 and the vibrating guide 19 play an important role in providing a periodical change in the linear axial velocity of the running filament before the guide 19. This periodical change in the filament speed is transferred to the extruded filament 22 just below the spinneret and above the surface of the liquid bath 11, which makes it possible to embody the thick-and-thin profile in the filament 23 owing to the mass conservation. The vibrating guide 19 should preferably move parallel to the running direction of the entering filament 20, but nonparallel movement of the guide 19 against the running direction may be applied if necessary. The guide 19 should be light enough to allow a swift periodical movement without fail. The vibrating motion of the guide 19 can be induced by any known procedures such as a mechanical system by cam and electromagnetic mechanism, which need not to be specified here. The filament that has passed the roller system 21 is next preheated on the warm roller system 24 as long as necessary, then runs in touch with a heated plate 25 if desired, and then wraps around the roller system 26 which rotates at a higher peripheral speed than the warm roller system 24, wherein the drawing of the extruded and solidified thick-and-thin filament is carried out, and finally the drawn thick-and-thin filament 27 is collected on a spool.

In the above explanation the melt extrusion of thermoplastic polymers has been assumed. However, in case of the solution spinning the quenching bath 11 in the above explanation should be, of course, a coagulating bath and interpreted as such. This kind of the transformation of the concept is known in the art.

The fiber forming synthetic polymers used in the present invention comprise polyesters such as poly(ethyleneterephthalate) and poly(butyleneterephthalate), polyamides such as polycaprolactam and poly(hexamethyleneadipamide), polyacrylonitriles and their copolymers. The extrusion of the filaments can be carried out by the use of conventionally known spinning machinery.

The shape of the spinneret hole may be circular or noncircular, depending on the final use of the thick-and-thin fibers. In case of the noncircular cross section the final shape of the cross section of the thick-and-thin fibers is almost the same as that of the spinneret hole, which is quite a characteristic feature of the present process since in the conventional melt spinning the shape of the final noncircular cross section is considerably distorted in comparison with that of the original spinneret hole. The way to cope with such a difference, however, may be a well-known in the art. The area of the cross section of the spinneret hole should be as small as possible so far as allowed since the realization of the high thick-and-thin ratio becomes easier as the area of the cross section of the spinneret hole decreases.

The existence and distance of the gaseous gap between the spinneret and the quenching or coagulating liquid bath is indispensible in the present invention, and the distance should be less than six millimeters. The reason is that high thick-and-thin ratio as specified in the present invention can be accomplished only by the application of such a short gaseous gap, and that if this distance is increased beyond the above limit, a deleterious phenomenon of so-called draw resonance takes place, resulting in difficulty for the stable manufacturing of the thick-and-thin fibers. The lower limit of the distance of the gaseous gap can be as small as allowable in an industrial sense. However, a distance from one to three millimeters is preferable. If the remaining conditions are fixed, the thick-and-thin ratio increases as the distance of the gaseous gap decreases. The distance of the gaseous gap, therefore, can be adjusted by the desired value of the thick-and-thin ratio. The gas in the gaseous gap may be preferably air, but other gas such as nitrogen, argon can be used if necessary so long as it does not abruptly cool down the extruded molten filaments.

In melt spinning, the liquid of the quenching bath may be any substance so long as its boiling point is less than the glass transition temperature of the polymer concerned. Of course, water should be the first choice. The temperature of the quenching liquid bath should be less than the glass transition temperature of the polymer concerned. It is allowed that the temperature of the liquid is locally above the glass transition temperature of the polymer concerned. The filaments abruptly cool down to less than the glass transition temperature as soon as they plunge into the quenching liquid bath, and then convert their running direction at a stationary or rotating guide, and finally emerge from the quenching liquid bath.

Figure 6:
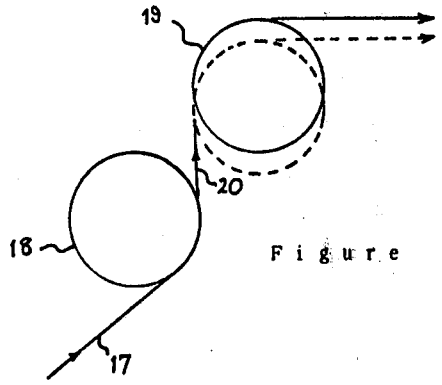
FIG. 6 is the enlarged illustration of a part in FIG. 5.

The amplitude and the frequency of the vibrating guide can be determined by the required values of the thick-and-thin ratio and the thick-and-thin recurring length. As depicted in FIG. 6, a touch with a guide 18 to secure the direction of the running filaments before the touch with the vibrating guide 19 is preferable.

The roller systems for the withdrawal of the filaments at a constant speed and for the drawing process may be provided in a conventional form as is common in the art. It is preferable that heated rollers are used supplementarily for the stable performance of the drawing. Multi-stages drawing wherein the drawing process is carried out in more than two stages can be also considered. The drawing process should be carried out so that the thick-and-thin ratio of the drawn filament is always larger than that of the undrawn filament. This is a fundamental requirement of the stable production of the thick-and-thin fibers in the present invention. Therefore, the thick-and-thin ratio and the thick-and-thin recurring length of the undrawn filaments should be designed to meet this requirement. Heat setting with or without some relaxation is also taken into account. To this end any methods that are useful and well known in the art can be applied.

The thick-and-thin fibers according to the present invention can provide a unique effect in the appearance and hand of fabrics produced therefrom if they are used as a component. They are useful not only for pile fabrics to simulate natural furs but also for fabrics with the other special effects such as dry touch or moire pattern on account of the coexistence of different portions of various deniers and twist.

The thick-and-thin fibers can be easily converted into staple fibers with either or both ends cut at the thin portions by virtue of their excellent phase coherency of the thick-and-thin profile among the multi-filaments. Further sharpening of the thin end by mechanical or chemical methods can be carried out if desired. They can be preferably suitable for a component of simulated furs and brushes.

Although the present invention is good at affording the thick-and-thin fibers with excellent phase coherency of the thick-and-thin profile among filaments, randomization of this thick-and-thin profile among the filaments is also easy and can be applied if desired. Such thick-and-thin fibers may be preferably used, for example, in a process such as spinning with simultaneous cutting.

For the purpose of illustration only, this invention will now be illustrated by the following examples. Of course, this invention should not be limited to the following examples.

EXAMPLE 1

From a spinneret with 48 holes, each 0.4 millimeters in diameter, poly(butyleneterephthalate) was melt-spun at 260° C. with a total throughput of 7.2 grams per minute. The extruded filaments ran through 1.5 millimeters of an air gap and thereafter plunged into a liquid quenching bath maintained at about 0° C., where they were submerged for 50 centimeters. They were then touched by a vibrating guide which vibrated in the same direction as the running filaments with an amplitude of 1.5 millimeters and a frequency of 1200 cycles per minute, and thereafter were withdrawn at the speed of 11.4 meters per minute by a rotating roller system on which the filaments were wrapped three times. The filaments were then preheated by running with five wraps on a roller system whose diameter was 100 millimeters and whose temperature was controlled at 50° C., and then drawn by a roller system which rotated at a peripheral speed of 34.2 meters per minute.

The thick-and-thin fibers thus obtained had a thick-and-thin ratio of 9:1, a thick-and-thin recurring length of 34 millimeters, a coefficient of variation of the thick-and-thin recurring length of 1.0 percent, and an inphase value of the thick-and-thin profile among the filaments of 86 percent.

The thick-and-thin fibers were cut into staple fibers by cutting selectively at the thin portion with a cut length of 68 millimeters which corresponded to twice the thick-and-thin recurring length. About eighty percent of the staple fibers thus obtained took practically the same profile with both of the ends thin and a thin portion in the middle of the staple fibers, as depicted in FIG. 3(*g*).

EXAMPLE 2

From a spinneret with 96 rectangular holes, each of 0.12 millimeters width and 0.36 millimeters length, poly(ethyleneterephthalate) was melt-spun at 290° C. with a total throughput of 34.6 grams per minute. The extruded filaments ran through an air gap of 2.0 millimeters and thereafter plunged a liquid quenching bath maintained at about 25° C., where they were submerged for 75 centimeters. They were then touched by a vibrating substance which vibrated in the same direction as the running filaments with an amplitude of 2.5 millimeters and a frequency of 2400 cycles per minute, and thereafter were withdrawn at a speed of 38.4 meters per minute by a rotating roller system on which the filaments were wrapped four times. The filaments were then preheated by running with eight wraps on a roller system whose diameter was 130 millimeters and whose temperature was controlled at 100° C., and then drawn by a roller system which rotated at a speed of 127 meters per minute, and then heat set under 5 percent relaxation in touch with a heating plate two meters in length and maintained at 220° C.

The thick-and-thin fibers thus obtained had a thick-and-thin ratio of 7:1, a thick-and-thin recurring length of 53 millimeters, a coefficient of variation of the thick-and-thin recurring length of 1.5 percent and a inphase value of the thick-and-thin profile among filaments of 92 percent.

The thick-and-thin fibers were then cut into staple fibers by cutting selectively at the thin portion with a cut length of 106 millimeters corresponding to twice the thick-and-thin recurring length. About eighty percent of the staple fibers thus obtained took practically the same profile with both of the ends thin and a thin portion in the middle of the staple fibers as depicted in FIG. 3(*g*).

EXAMPLE 3

From a spinneret with 36 holes, each 0.4 millimeters in diameter, poly(butyleneterephthalate) was melt-spun at 270° C. with a total throughput of 3.5 grams per minute. The extruded filaments ran through an air gap of 1.5 millimeters and thereafter plunged into a liquid quenching bath maintained at about 10° C., where they were submerged for 50 centimeters. They were, then, touched by a vibrating bar which vibrated in the same direction as the running filaments with an amplitude of 1.5 millimeters and a frequency of 1200 cycles per minute, and thereafter were withdrawn at a peripheral speed of 9.5 meters per minute.

The thick-and-thin filaments thus obtained had a thick-and-thin ratio of 5:1, and thick-and-thin recurring length of 8 millimeters. They must be, however, additionally drawn because the as-spun thick-and-thin filaments had too great an extensibility at break to be used for the end use. The drawing, therefore, carried out by means of a hot roller system with the drawing ratio of 3.1:1 followed by nonrelaxing heat-set at 180° C. for 1.3 seconds. The drawing performance was very good without any breakage of filaments. The drawn thick-and-thin fibers thus obtained had a thick-and-thin ratio of 9:1 and a thick-and-thin recurring length of 25 millimeters together with low variation in the ratio and the recurring length among the filaments. The birefringences at the thin portion and the thick portion were 0.150 and 0.040, respectively.

Comparative Example 1

In the previous example 3 the drawing ratio was increased so that the thick-and-thin ratio of the drawn filaments was equal to that of the undrawn filaments. The result is summarized in Table I, which indicates that the breakage of the filaments took place and that stable drawing cannot be accomplished under conditions to realize equal thick-and-thin ratios both at the undrawn stage and at the drawn stage.

TABLE I

| | Processibility on Drawing | |
|---|---|---|
| | Thick-and-Thin Ratio of Drawn Filaments / Thick-and-Thin Ratio of Undrawn Filaments | |
| Drawing Ratio | | Processibility at the Drawing |
| 3.1 | 1.8 | Good |
| 4.5 | 1.2 | Not so good |
| 5.5 | 1.0 | Very bad |

EXAMPLE 4

The thick-and-thin filaments obtained in the previous example 2 were cut into staple fibers by cutting selectively at the thin portion with a cut length of 53 millimeters. The staple fiber thus obtained had a fiber length of 53 millimeters and an average fiber fineness of 27 denier, and took a shape with thin portions at both ends and a thick portion in the middle of the staple fiber as depicted in FIG. 3(*b*).

The thick-and-thin staple fibers thus obtained were used with conventional staple fibers to make a mixed yarn of 16's count and 400 twists per meter. The composition of the mixed yarn is as follows:

(1) Thick-and-thin staple fibers of the present invention 27 denier—53 millimeters: 10 weight percent (2) Conventional acrylic staple fibers 3 denier—51 millimeters: 55 weight percent (3) Conventional nylon staple fibers 1.5 denier—51 millimeters: 35 weight percent A two ply yarn of the above mixed yarns was knitted using a weft knitting machine. The knitted fabric was then treated slightly by a gig mill, to bring about a new knitted fabric with excellent aesthetics and the appearance of fabric containing natural hairs.

EXAMPLE 5

The thick-and-thin staple fibers obtained in example 4 were used with the following conventional staple fibers to make a mixed yarn of 20's count using a conventional woolen spinning machine. The composition of the mixed yarn is as follows:

(1) Thick-and-thin staple fibers of the present invention 27 denier—53 millimeters: 50 weight percent (2) Conventional polyester staple fibers 1 denier—51 millimeters: 50 weight percent.

Using this mixed yarn as weft and the conventional false-twist texturized polyester yarn of 150 denier and 48 filaments as warp, plain woven fabric was made. Additional treatment of the fabric by a gig mill brought about a new woven fabric with excellent aesthetics and the appearance of fabric containing natural hairs.

Comparative Example 2

From a spinneret with 160 holes, each of 0.45 millimeters in diameter, poly(ethyleneterephthalate) was melt-spun at 290° C. using a total throughput of 68 grams per minute. The extruded filaments ran through an air gap of 15 millimeters and plunged into a liquid quenching bath maintained at about 10° C., where they were submerged for 100 centimeters. They were, then, touched by a vibrating bar which vibrated in the same direction as the running filaments with an amplitude of 8 millimeters and a frequency of 900 cycles per minute, and thereafter were withdrawn at a speed of 47 meters per minute. The undrawn thick-and-thin filaments were then drawn three times to provide thick-and-thin filaments with a thick-and-thin ratio of 2:1 and a thick-and-thin recurring length of 157 millimeters.

The thick-and-thin filaments thus obtained were cut into staple fibers of average fiber fineness of 27 denier by cutting selectively at the thin portion with a cut length of 157 millimeters. Since these thick-and-thin staple fibers a longer thick-and-thin recurring length and smaller thick-and-thin ratio than those in example 5, they were difficult to spin unless additional crimp was incorporated.

EXAMPLE 6

From a spinneret with 160 rectangular holes, each 0.14 millimeters in width and 0.32 millimeters in length poly (butyleneterephthalate) was melt-spun at 270° C. with a total throughput of 15.7 grams per minute, and then processed just as in example 3 to give thick-and-thin filaments with a thick-and-thin ratio of 9:1, a thick-and-thin recurring length of 25 millimeters and an inphase value of the thick-and-thin profile among the filaments of 90 percent. They were then cut into staple fibers by cutting selectively at the thin portion with a cut length of 50 millimeters, corresponding to twice the thick-and-thin recurring length.

The thick-and-thin staple fibers thus obtained were used with conventional acrylic staple fibers of high shrinkage at boiling to make a sliver whose composition is as follows:

(1) Thick-and-thin staple fibers of the present invention 30 denier—50 millimeters: 50 weight percent The fineness at the thick portion is 90 denier The fineness at the thin portion is 10 denier (2) Conventional acrylic staple fibers of 32 percent shrinkage at boiling 3 denier—38 millimeters: 50 weight percent The sliver was fed to a sliver knitting machine to make pile fabric using acrylc spun yarn of 30's count as the base yarn. The pile fabric then underwent backing with acrylic resin, heat setting and finally polishing to give a simulated fur with an excellent hand and appearance.

Comparative Example 3

In the process to make the thick-and-thin filaments just described in previous example 6, only the distance of the air gap was changed from 1.5 to 8 millimeters. The thick-and-thin filaments thus obtained had low thick-and-thin ratio of 3:1, a thick-and-thin recurring length of 25 millimeters, and an inphase value of the thick-and-thin profile among the filaments of 90 percent.

The thick-and-thin filaments were converted to staple fibers and used to make a pile fabric by the same procedure as described in previous example 6. The resultant pile fabric had only an inferior character in its hand and appearance to that obtained in example 6, indicating that the low thick-and-thin ratio could not exhibit the thick-and-thin characteristics desired.

EXAMPLE 7

Four kinds of the thick-and-thin fibers which differed from each other only in their fineness were made, and then used to make pile fabrics as in example 6. The properties of the resultant pile fabrics are given in Table II, which indicates that there is a proper fineness in simulating natural furs.

TABLE II

| Average Fineness of Thick-and-Thin Fibers | Estimation on Fabrics | |
|---|---|---|
| | Hand | Appearance |
| 5 denier | Soft | Good |
| 30 denier | Soft | Excellent |
| 200 denier | A little hard | Good |
| 510 denier | Hard | Bad |

Comparative Example 4

By a proper manipulation the guides in example 6, randomization in the filament running length among the filaments gave thick-and-thin fibers of low inphase value of 30 percent which meant that the phases of the thick-and-thin profile did not coincide well with each other among the filaments. The thick-and-thin ratio and the recurring length were 3:1 and 25 millimeters, respectively. The staple fibers which were made by cutting the thick-and-thin filaments with a cut length of 50 millimeters consisted of various kind of staple fibers whose shapes were quite random.

A pile fabric made of these staple fibers by the sliver knitting machine as in the example 6 had inferior hand and appearance for simulated fur.

EXAMPLE 8

From a spinneret with five rectangular holes, each of 0.14 millimeters width and 0.32 millimeters length, poly (butyleneterephthalate) was melt-spun at 270° C. with a total throughput of 0.5 grams per minute, and then processed just as in example 3 to give thick-and thin filaments with a thick-and-thin ratio of 9:1, a thick-and-thin recurring length of 25 millimeters, an inphase value of 90 percent, and average fiber fineness of 30 denier.

The thick-and-thin filaments thus obtained were converted to a ply yarn with a high shrinkage polyester filaments of 35 percent shrinkage at boiling and a total fineness of 75 denier with 72 filaments.

The yarn was used as pile yarn in a double velvet loom with two ply polyester spun yarn of 30's count as base yarn. The pile yarn was woven in such a way that the thin portion of the pile yarn, which corresponded to the thin portion of the thick-and-thin filaments included, was always situated so that the thin portion could protrude from the base fabric and one thin portion could be sandwiched between the two thick portions and be cut at this thin portion by a knife. The resultant pile fabrics were then heated to bring about pile fabrics with two kinds of pile length by virtue of the high shrinkage of one of the component fibers in the pile yarn. The pile fabrics were further finished with lubricant oil and polished. The final pile fabrics took an excellent appearance and hand just like natural mink fur.

EXAMPLE 9

The thick-and-thin filaments obtained in the previous example 8 were converted into a mixed twisted yarn with high shrinkage polyester filaments of 40 percent shrinkage at the boiling, whose total denier was 150 denier with 148 filaments. The yarn was tufted on a nonwoven fabric so that the thin portion of the yarn, which corresponded to the thin portion of the thick-and-thin filaments included, could be situated both on the base nonwoven fabric and over it with a thick portion between them, and the thin portion floating above the thick portion over the ground fabric was cut a knife.

The resultant pile fabric then underwent heat treatment to bring about two kinds of pile of different pile length, and thereafter was immersed in alkali solution so that the free ends of the pile could be sharpened. The back side of the pile fabric was finished with a polyurethane resin to fix the pile on the base nonwoven fabric, and then finishing with lubricant and polishing were carried out. The final pile fabric consisted of two kinds of pile, whose length from the surface of the base fabric were 23 millimeters and 14 millimeters in average, and their densities were about 500 fibers per square centimeter and about 15000 fibers per square centimeter, respectively. This pile fabric had excellent appearance and hand and flexibility just like natural mink fur.

Comparative Example 5

By a proper manipulation at guides in example 8, thick-and-thin filaments of low inphase value of 30 percent were produced by randomization in the filament running length among the filaments. A mixed yarn was made with the above thick-and-thin filaments and the high shrinkage polyester filaments used in example 9. The yarn was tufted as in the example 9, but in this case the selective positioning of the thin portion could be accomplished because of the bad coherency of the thick-and-thin profile among the filaments. The final pile fabric had various pile fibers of different shapes, and had an inferior appearance and hand when compared to the corresponding one in previous example 9.

EXAMPLE 10

From a spinneret with 10 rectangular holes, each of 0.14 millimeters width and 0.32 millimeters length, poly (butyleneterephthalate) was melt-spun at 270° C. with a total throughput of 0.5 gram per minute, and then processed just as in example 3 to give a thick-and-thin 10 filaments fiber of 150 denier with a thick-and-thin ratio of 9:1, a thick-and-thin recurring length of 25 millimeters, an inphase value of 90 percent, and average fiber fineness of 15 denier.

Using the thick-and-thin filaments as weft yarn and conventional polyester textured yarn of 150 total denier and 48 filaments as warp yarn, twelve-harness weft sateen fabric was woven. The resultant fabric had the thick-and-thin filaments on the surface, and exhibited a unique and beautiful brightness and hand.

Next, raising of the weft yarn by cutting the thin portion by a gig mill and then buffing brought about a new pile fabric with an excellent hand as if natural hairs had been mixed in.

While the principles of the invention have been illustrated and described in detail, it is to be clearly understood that this description is made only by way of example and not as a limitation on the scope of the invention.

What is claimed:

1. Pile fabric having a base fabric and a surface at least partly covered with thick-and-thin fibers whose fineness along the longitudinal direction varies gradually characterized by the following items (a), (b), (c), and (d):

(a) the thick-and-thin recurring length, defined as a longitudinal length along the fiber axis between adjacent thick portions, lies in the range of five to 500 millimeters, (b) the thick-and-thin ratio, defined as a ratio of the cross-sectioned area of the thick portion to that of the adjacent thin portion, lies in the range of four to 50, (c) the cross-sectioned area at both the thick portions and those at the thin portions being almost constant, and (d) the average fineness of the thick-and-thin fiber lies in the range of 0.05 to 2000 deniers and, wherein the thick portion of each thick-and-thin fiber floats over the base fabric and the thin portion is anchored on the base fabric.

2. Pile fabric according to claim 1, wherein the piles thereof consist of at least two kinds of fibers, one of which comprises the thick-and-thin fibers.

3. Pile fabric according to claim 2, wherein the fiber length of the thick-and-thin fibers which constitute the piles is at least 25 percent longer than that of the other pile fibers.

4. Pile fabric according to claim 2, wherein the thick-and-thin fibers are in average at least 25 percent higher than the other piles.

5. Pile fabric according to claim 2, wherein the pile comprises thick-and-thin fibers and one kind of conventional fibers selected from polyester fibers, polyamide fibers, polyacrylonitrile fibers, cotton, wool, hemp, and mixed fibers thereof.

6. Pile fabric according to claim 2, wherein the piles comprise 10 to 90 weight percents of thick-and-thin fibers with their fiber length of 2.5 to 250 millimeters and their average fiber fineness of 0.05 to 2000 deniers, and 90 to 10 weight percents of conventional fibers selected from polyester fibers, polyamide fibers, polyacrylonitrile fibers, cotton, wool, and hemp whose fiber length lies in the range of one to 250 millimeters and their average fiber fineness lies in the range of 0.05 to 2000 deniers.

7. Pile fabric according to claim 1, wherein the free end of the thick-and-thin fibers consists of the thin portion of the thick-and-thin fibers.

8. Pile fabric according to claim 2, wherein the pile density of the thick-and-thin fibers lies in the range of 0.5 to 1,000,000 fibers per square centimeter, and that of the remaining fibers which are selected from polyester fibers, polyamide fibers, polyacrylonitrile fibers, cotton, wool, and hemp lies in the range of 0.1 to 100,000,000 fibers per square centimeter.

9. The pile fabric according to claim 1 wherein the fibers lie in the range of 0.05 to 2,000 deniers and wherein said fibers comprise a plurality of thick-and-thin fibers whose inphase value is at least 60 percent, said inphase value indicating the phase coherency of the thick-and-thin profile among the multi-fibers and being defined by the formula:

$$G = \left( 1 - \frac{\sum_{i=1}^{n} \left| m_i - \frac{\sum_{j=1}^{n} m_j}{n} \right|}{n(L/2)} \right) \times 100$$

wherein

G is a notation for the inphase value, n is number of the filaments in the thick-and-thin fibers, $m_i$ and $m_j$ are the nearest distance of the thick portion from the standard position set out arbitrarily on the fibers with sign to designate the direction, and L is an average thick-and-thin recurring length.

* * * * *